US011414830B2

(12) United States Patent
Betz, II et al.

(10) Patent No.: US 11,414,830 B2
(45) Date of Patent: Aug. 16, 2022

(54) REVERSE TRAM INTERLOCK

(71) Applicant: The Toro Company, Bloomington, MN (US)

(72) Inventors: Gerard G. Betz, II, Eden Prairie, MN (US); Ryan W. Cunningham, Woodbury, MN (US); James Kuemper, New Hope, MN (US); Michael H. Benedict, Minneapolis, MN (US)

(73) Assignee: The Toro Company, Bloomington, MN (US)

( * ) Notice: Subject to any disclaimer, the term of this patent is extended or adjusted under 35 U.S.C. 154(b) by 279 days.

(21) Appl. No.: 16/724,074

(22) Filed: Dec. 20, 2019

(65) Prior Publication Data

US 2020/0199845 A1 Jun. 25, 2020

Related U.S. Application Data

(60) Provisional application No. 62/784,313, filed on Dec. 21, 2018.

(51) Int. Cl.

| | |
|---|---|
| ***E02F 5/14*** | (2006.01) |
| ***E02F 9/22*** | (2006.01) |
| ***E02F 9/20*** | (2006.01) |
| *E02F 3/88* | (2006.01) |

(52) U.S. Cl.

CPC ..... *E02F 5/145* (2013.01); *E02F 9/2033* (2013.01); *E02F 9/2253* (2013.01); *E02F 3/8816* (2013.01)

(58) Field of Classification Search

CPC ..... E02F 5/145; E02F 9/2033; E02F 9/2037; E02F 9/2253; E02F 3/8816

See application file for complete search history.

(56) References Cited

U.S. PATENT DOCUMENTS

| | | | | |
|---|---|---|---|---|
| 3,876,020 | A * | 4/1975 | Barsby | B60K 17/10 180/6.48 |
| 4,036,321 | A * | 7/1977 | Habiger | B62D 11/02 180/6.48 |
| 6,415,532 | B1 * | 7/2002 | Bricko et al. | E02F 3/143 37/352 |
| 6,460,640 | B1 * | 10/2002 | Keagle et al. | A01B 51/02 180/19.3 |
| 7,930,843 | B2 * | 4/2011 | Hartwick | B62D 11/001 37/348 |
| 9,719,468 | B2 * | 8/2017 | Kakuk et al. | F02M 35/024 |
| 2007/0227803 | A1 * | 10/2007 | Sewell et al. | E02F 5/06 180/324 |
| 2008/0090699 | A1 * | 4/2008 | Welch | B60W 10/02 477/115 |
| 2008/0197588 | A1 * | 8/2008 | Azure et al. | E02F 9/0808 280/32.7 |
| 2009/0000156 | A1 * | 1/2009 | Hartwick et al. | F16H 61/465 37/348 |
| 2009/0077836 | A1 * | 3/2009 | Azure et al. | E02F 3/085 37/352 |

(Continued)

*Primary Examiner* — Tara Mayo-Pinnock

(74) *Attorney, Agent, or Firm* — Inskeep IP Group, Inc.

(57) ABSTRACT

The present Application discloses a trenching device with two operational modes, Mode 1 and mode 2. In Mode 1, the trenching lever is disengaged, the device does not trench, but only functions as a transporting unit in a forward direction with a maximum speed. In Mode 2, the trenching lever is engaged, the device starts trenching, but stops functioning as a transporting unit.

20 Claims, 5 Drawing Sheets

(56) References Cited

U.S. PATENT DOCUMENTS

| | | | | |
|---|---|---|---|---|
| 2011/0078929 | A1* | 4/2011 | Hartwick et al. ..... | E02F 9/2253 37/195 |
| 2020/0032480 | A1* | 1/2020 | Kukuk et al. ..... | E02F 9/2004 |
| 2020/0032483 | A1* | 1/2020 | Ready-Campbell et al. ..... | G05D 1/0274 |

* cited by examiner

SECTION A-A

SECTION A-A

| | **Forward speed** | **Reverse Speed** | |
|---|---|---|---|
| **Trenching** | Not applicable (re-position machine) | Speed limited by work | **Mode 2** |
| **Not trenching (transport unit)** | No forward speed limit | 1.55 MPH maximum | **Mode 1** |

FIG. 5

REVERSE TRAM INTERLOCK

RELATED APPLICATIONS

This application claims benefit of and priority to U.S. Provisional Application Ser. No. 62/784,313 filed Dec. 21, 2018 entitled Reverse Tram Interlock, which is hereby incorporated herein by reference in its entirety.

FIELD OF THE INVENTION

The present invention pertains to speed acceleration of a walk-behind hydraulic trencher in a forward direction when it functions only as a transporter and not as a trencher.

BACKGROUND OF THE INVENTION

A trencher is a chainsaw-like device with blades for digging a trench in the ground to run irrigation lines, cables, etc. The machine is entirely hydraulic. An engine generates hydraulic pressure that is used to run the chain, and also to power the wheels of a vehicle that transports the trencher. In operation, the blade of the trencher is angled from the drive mechanism toward the ground. The blade is dragged along the ground while trenching. This necessarily means that, in the case of smaller trenchers in which the operator is walking, that the operator is walking backwards in advance of the direction of travel of the trencher.

In order to avoid prevent getting run over or otherwise injured by the trencher, such as if the operator tripped, there is a safety standard that specifies the maximum reverse travel speed is an ANSI limit of 1.55 mph. Sometimes trenching is done a fair distance away from the vehicle that transports the trencher and this slow speed means a lot of time is lost from transporting the trencher from the vehicle to the job site. It would thus be beneficial to develop a trencher that meets the ANSI regulations, while allowing the trencher to travel at a faster speed in the forward direction when the blade is disengaged.

OBJECTS AND SUMMARY OF THE INVENTION

The present application overcomes the slow movement by allowing the trencher to move in a forward direction at a much faster speed when the blade is disengaged and the trencher is in "transporting" mode. Interlocks are provided that limit the reverse movement of the traction levers so that when the machine is moving with the trencher chain disengaged, the reverse travel speed is limited to the ANSI requirements. When the auxiliary lever is disengaged from the trenching position, the interlocks are shifted to a second, engaged position, allowing full stroke of the levers in the forward direction but restricted motion of the levers in the rearward direction.

One aspect of the invention provides a trenching device which functions as a transporter in a forward direction while not trenching and as a trencher in a backward direction while not transporting, comprises an auxiliary trenching lever; a reference bar; a set of traction levers; a transporting pump section and a trenching pump section; a trenching motor; a reverse tram interlock shaft; moving cams attached to said reverse tram interlock shaft; tabs positioned on said set of traction levers; a return spring; and a plate with a directional control valve.

Another aspect of the invention provides a trenching device that functions as the transporter when the auxiliary trenching lever is placed in a neutral position and the traction levers are disabled by pulling from a maximum reverse speed position.

Still another aspect of the invention provides a trenching device that functions as the trencher when the auxiliary trenching lever is placed in an engaging position and the traction levers are enabled by pulling to a maximum reverse speed position.

Yet another aspect of the invention is a trenching device that functions as the transporter in the forward direction when a flowrate of a combination of said transporting pump section and the trenching pump section performs transporting only by maximizing a transporting speed.

In one or more embodiments, the flowrate of the transporting pump is 3 GPM and the flowrate of said trenching pump is 13 GPM.

In one or more embodiments, the trenching device is able to obtain a maximum transporting speed with a combined flowrate of 16 GPM of the transporting pump and said trenching pump.

One aspect of the invention provides a trenching device that functions as a trencher in the backward direction when the flowrate of the transporting pump section is limited and the maximum flow to the trenching motor is obtained by the trenching pump only.

Another aspect of the invention is a trencher that, while in a neutral position, has an auxiliary trenching lever that disengages from the reference bar when said reverse tram interlock shaft is pushed by the return spring against the plate with the valve control manifold which is attached to said first auxiliary trenching lever.

Yet another aspect of the invention is a trencher that has a set of traction levers that are limited by pulling the trenching levers from a maximum reverse speed position. The trencher has a reverse tram interlock shaft that is configured to then move to a neutral position by the return spring and lock the moving cams in positions underneath the tabs.

Yet another aspect of the invention is a trenching device that, when functioning as a trencher, has an auxiliary trenching lever that is configured to be engaged with the reference bar when the reverse tram interlock shaft is actuated against a return spring by a plate with a valve control manifold, which is attached to said first trenching lever.

Still another aspect of the invention is a trenching device that functions as a trencher when a set of traction levers are pulled to a maximum reverse speed position by unlocking moving cams from underneath tabs by moving the cams from the tabs through attached ramps.

The maximum reverse travel speed of the trenching device in the reverse direction does not exceed a specified 1.55 MPH rearward ANSI specification

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which

FIG. 5 is a chart showing Mode 1 and Mode 2 of the trenching device of the present application during operation.

DESCRIPTION OF EMBODIMENTS

Figure 1:
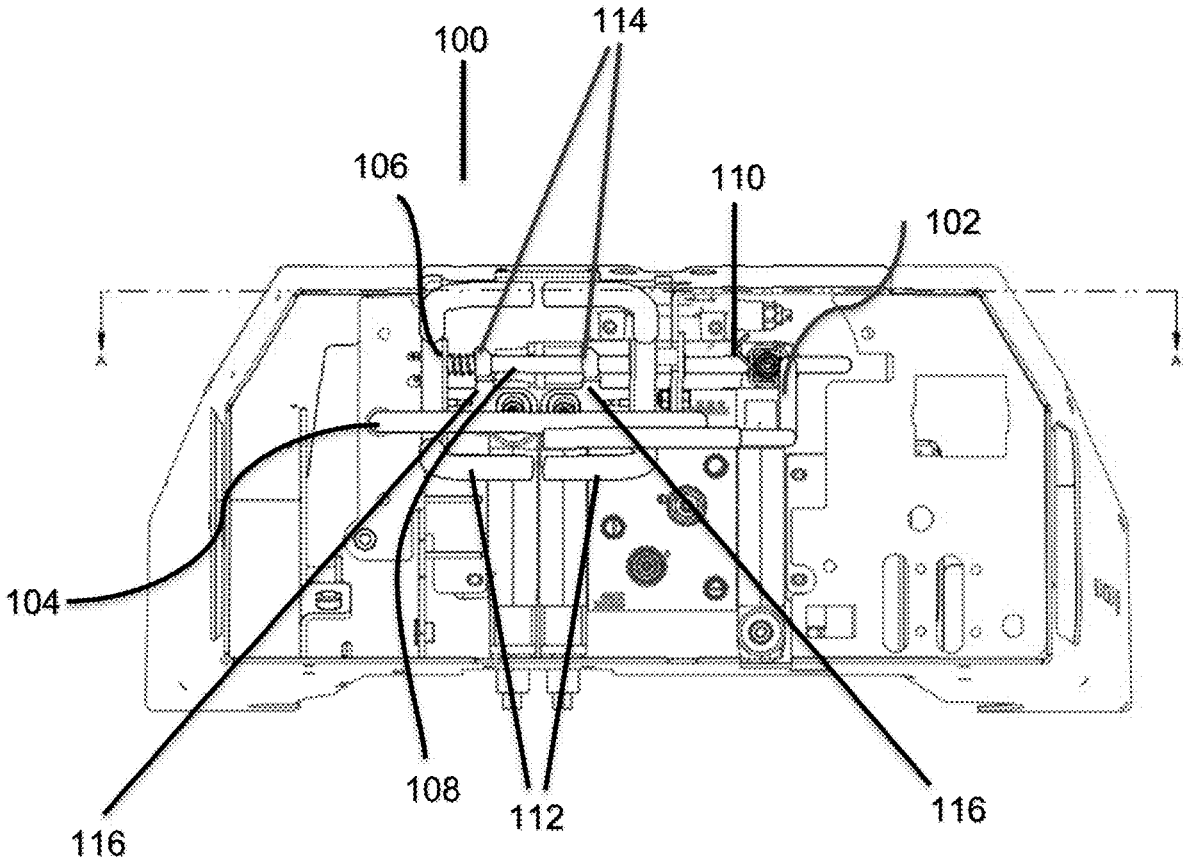
FIG. 1 is a top view of a control assembly of a trenching device when the device functions as a transporter in a forward direction.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings.

The trenching device of the present application operates in two modes, hereinafter, Mode 1 and Mode 2. In Mode 1, trenching blades of the trenching device are lifted up above the ground, the trenching device stops trenching in a reverse direction and functions only as a forward and backward transporting unit. In Mode 2, the trenching blades of the trenching device are lowered to allow initial penetration into the ground surface. Then the trenching blade is pulled through the ground rather than pushed to avoid digging itself straight into the ground. In this mode, the trenching device starts trenching in a reverse direction, and stops functioning as a forward transporting unit. Thus, in Mode 1, the device can go forward or reverse. In Mode 2, the device can only move in reverse.

In Mode 2, the hydraulic motor powering the trenching blade requires more hydraulic fluid than the hydraulic motor powering the wheels or tracks that transport the device. In one embodiment, 13 GPM are allocated to trenching while only 3 GPM are allocated to transporting. However, in Mode 1, some or all of the hydraulic fluid that is allocated to trenching in Mode 2 may be diverted to the hydraulic motor used for transporting, thereby increasing the maximum possible transporting speed.

However, for transport speed of the trenching device in a reverse direction, there is a safety standard that specifies the maximum reverse transport speed, which is an ANSI limit of 1.55 mph, whether the device is in Mode 1 or Mode 2 (transporting or trenching). This safety feature was put in place so that even if the operator trips and falls while walking in a reverse direction, the trenching device may not runover the operator because of its slower reverse transporting speed. However, there is no speed limit when the trenching device is used as a transporter in a forward direction.

The trenching device of the present application comprises a control assembly (100), a trenching assembly (not shown) and a drive assembly (not shown). The trenching assembly comprises trenching blades to dig trenches. A person of skill in the art would know the general configurations and operations of a trenching assembly. In one embodiment the drive assembly comprises a trencher motor or an engine to provide power to a 3 GPM transporting pump section and a 13 GPM trenching pump section. The control assembly controls the flow rates of the hydraulic fluids through the 3 GPM transporting pump section and 13 GPM trenching pump section to maneuver the drive assembly which eventually controls the functioning of the trenching device either as a forward transporter or as a reverse trencher.

Figure 2:
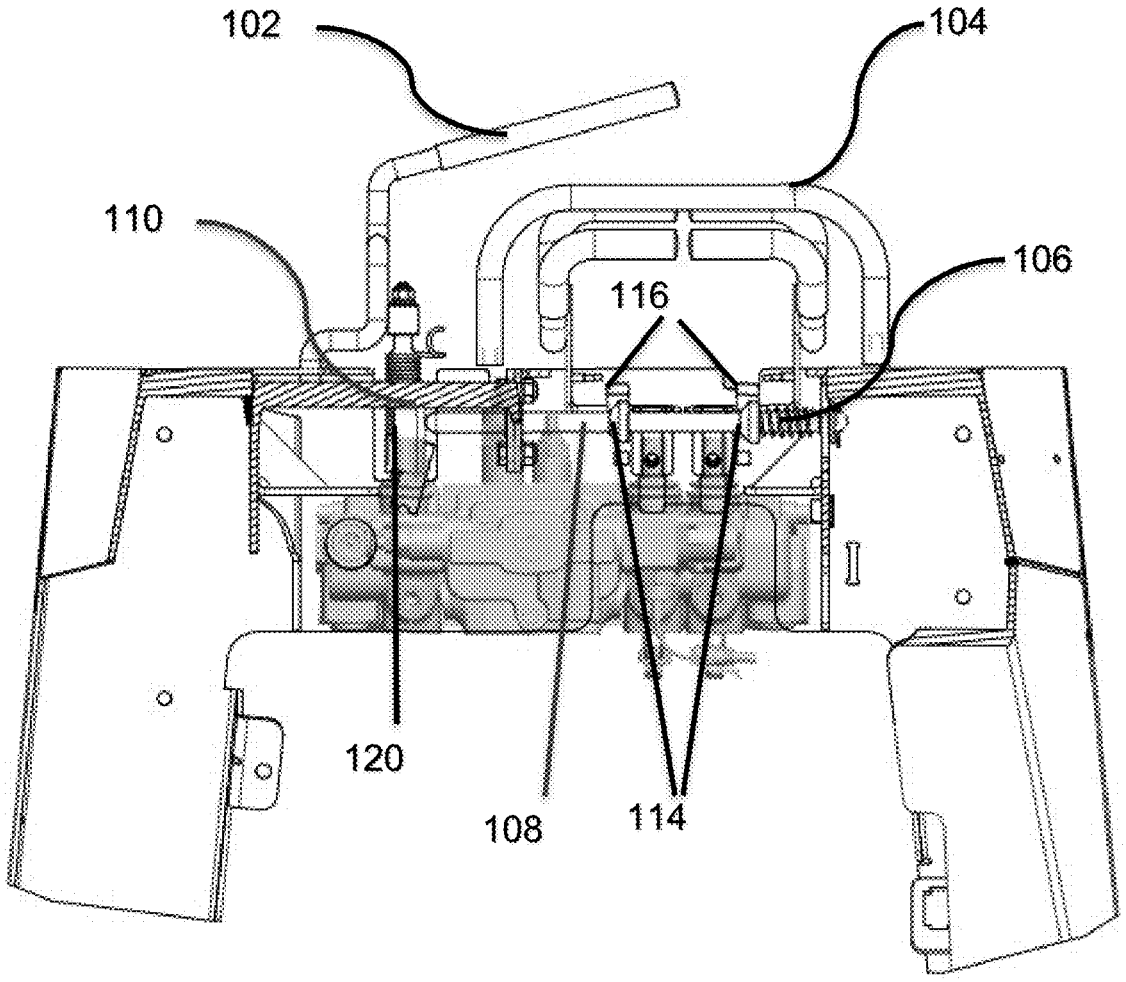
FIG. 2 is a cross-sectional view of the control assembly of the trenching device along the A-A axis of FIG. 1.

Referring now to the figures, and first to FIGS. 1 and 2, there is shown a control assembly (100) that generally comprises an auxiliary trenching lever (102), a reference bar (104), a return spring (106), a reverse tram interlock shaft (108), a plate (110) which is attached to the auxiliary trenching lever (102), a set of traction levers (112), two moving cams (114), two tabs (116) on the traction levers (112).

FIG. 2 is a cross-sectional view of FIG. 1 along A-A axis and it shows the device in the Mode 1 configuration. FIG. 2 also shows that the plate (110) is attached at one end to the auxiliary trenching lever (102) and at another end to a directional control valve (120) which controls the control assembly (100) to convert the device between a trencher and a transporter. In Mode 1, the trenching blades of the trenching device are lifted above the ground, the trenching device stops trenching in a reverse direction, and it only functions as a forward and reverse transporting unit. Mode 1 is achieved when an operator disengages the auxiliary trenching lever (102) from the reference bar (104) and places it in the neutral position. When the auxiliary trenching lever (102) is disengaged, the position of the plate 110 moves. The return spring (106) then acts against one of the cams (114) to keep the reverse tram interlock shaft (108) against the plate (110). The cams (114) are attached to the reverse tram interlock shaft (108) so as the reverse tram interlock shaft (108) moves axially, the cams (114) also change positions and become located underneath the two tabs (116) connected to the set of traction levers (112). Because the two cams (114) are located under the tabs (116), the rearward movement of the set of traction levers (112) is limited, thus limiting maximum transporting speed in the reverse direction. However, when the traction levers are moved forward to initiate forward transport, the tabs do not contact the cams and thus forward movement of the traction levers is not limited.

With the auxiliary trenching lever (102) in the disengaged position, the flow rates of the 3 GPM transporting pump section and the 13 GPM trenching pump section provide a combined 16 GPM flow of the hydraulic fluids to the traction motor. This allows the maximum transporting speed in a forward direction. As explained above, the speed in the reverse direction is mechanically limited by the restricted movement of the traction levers due to the interference between the tabs and the cams.

Figure 3:
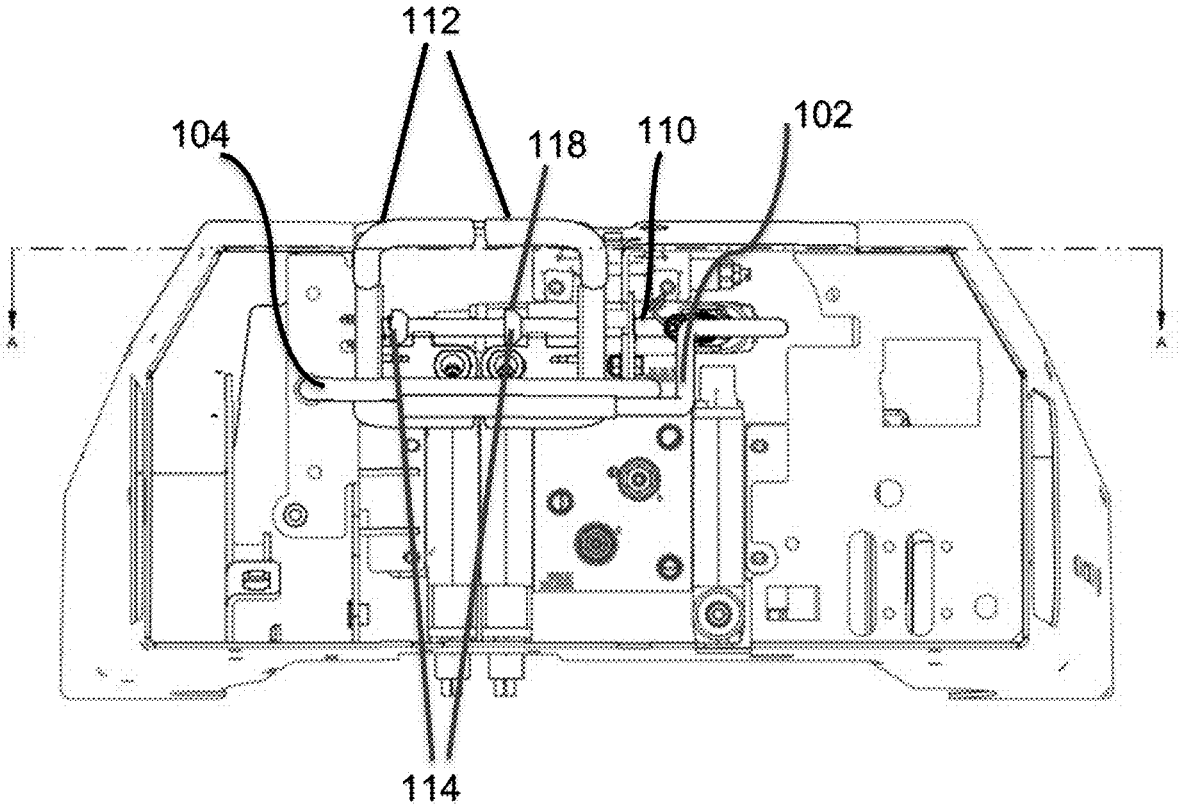
FIG. 3 is a top view of the control assembly of the trenching device when the device functions as a trencher in a reverse direction.
Figure 4:
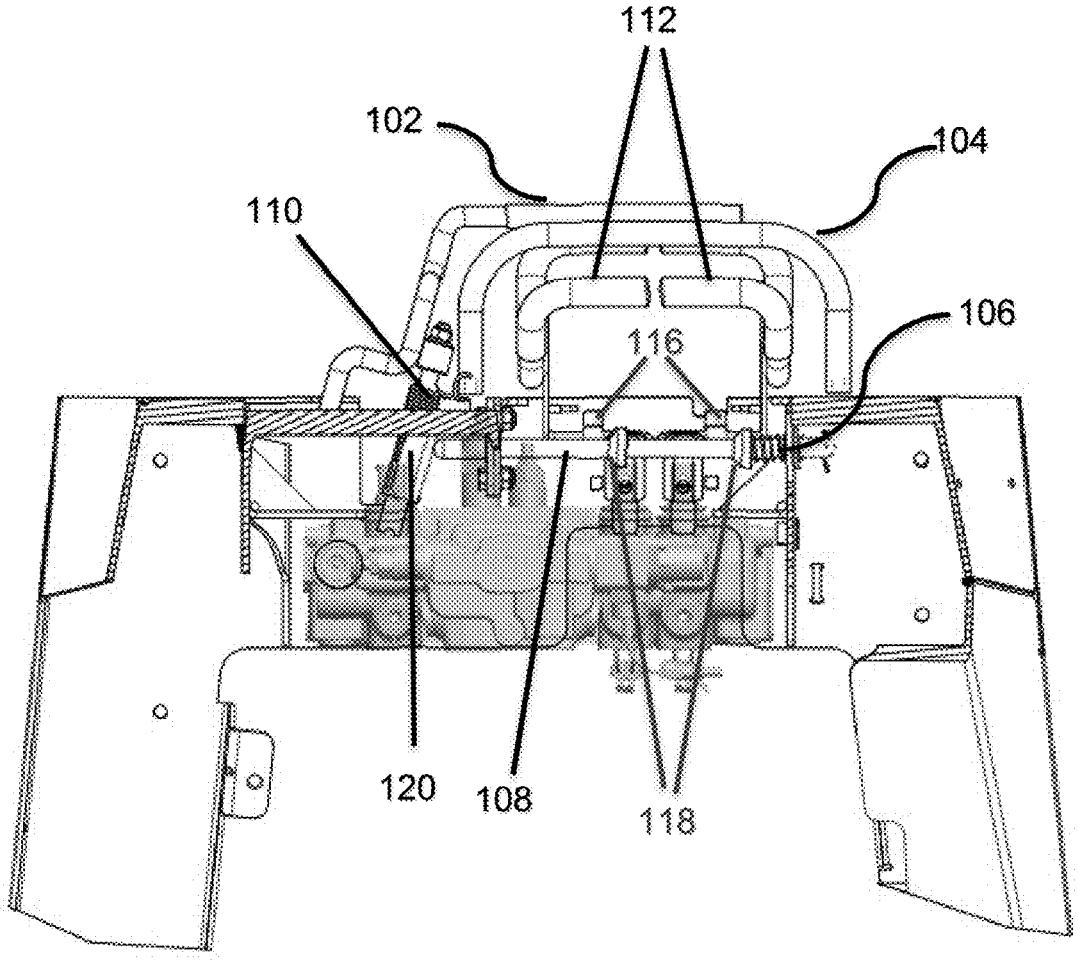
FIG. 4 is a cross-sectional view of the control assembly of the trenching device along the A-A axis of FIG. 3.

FIG. 3 shows a top view of the positions of the different elements of the control assembly (100) when the device is in the Mode 2 (trenching) configuration. FIG. 4 is a cross-sectional view of FIG. 3 along A-A axis. In the Mode 2 configuration, the trenching blades of the trenching device are lowered to allow initial penetration into the ground surface.

To achieve Mode 2, the operator engages the auxiliary trenching lever (102) with the reference bar (104). When the auxiliary trenching lever (102) engages the reference bar (104), the plate (110) which is attached to the auxiliary trenching lever (102) moves the reverse tram interlock shaft (108) against the return spring (106). This movement unlocks the set of traction levers (112) by moving the two cams (114) through attached ramps (118) from the positions underneath the two tabs (116) to the positions next to the two tabs. Both cams (114) feature ramps (118), so that when moving from Mode 1 to Mode 2, the cams (114) are able to ramp past the tabs (116).

This operation enables the set of traction levers (112) to be fully pulled to the maximum reverse speed position. When the set of traction levers (112) are pulled to the maximum reverse speed position, the trenching device starts trenching in the ground. At this moment, the flow rates of the 3 GPM transporting pump section is limited, so as not to exceed the specified 1.55 MPH rearward ANSI specification. The 13 GPM trenching pump section provides a maximum flow of the hydraulic fluids to the trencher motor which powers the trenching chain to trench the ground in a reverse direction.

FIG. 5 shows a chart describing Mode 1 and mode 2 of the trenching device during operation. In Mode 1, the trenching device functions only as a forward transporting unit while traveling at a faster speed with no speed limit when the trencher blade is disengaged. In Mode 2, the trenching device starts trenching in a reverse direction with specified maximum reverse trenching speed of an ANSI limit of 1.5 mph required by safety standard.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A trenching device comprising:

a control assembly that controls whether the trenching device assumes a transport mode or a trenching mode, the transport mode allowing forward and reverse movement of the trenching device, the trenching mode allowing only reverse movement of the trenching device while the trenching device is trenching, the control assembly including:

an auxiliary trenching lever, having a first position and a second position;

a reverse tram interlock shaft operably connected to the auxiliary trenching lever;

a traction lever moveable in a forward direction and a reverse direction and constructed and arranged to control the direction and speed of the trenching device;

wherein the reverse tram interlock shaft limits the movement of the traction lever in the reverse direction only when the auxiliary trenching lever is in the first position, thereby creating a limit of a maximum reverse transport speed of the trenching device; and, wherein the reverse tram interlock shaft does not limit the movement of the traction lever in the reverse direction when the auxiliary trenching lever is in the second position, thereby removing the limit of the maximum reverse transport speed.

2. The trenching device of claim 1 wherein the auxiliary trenching lever places the trenching device in the transport mode when the auxiliary trenching lever is in the first position.

3. The trenching device of claim 1 wherein the auxiliary trenching lever places the trenching device in the trenching mode when the auxiliary trenching lever is in the second position.

4. The trenching device of claim 1, further comprising:

at least one cam operably connected to the reverse transport interlock shaft;

at least one tab positioned on the traction lever;

wherein the cam contacts the tab to limit the movement of the traction lever in the reverse direction when the auxiliary trenching lever is in the first position.

5. The trenching device of claim 1, wherein:

the auxiliary trenching lever controls hydraulic fluid flow created by a trenching pump;

the traction lever controls hydraulic fluid flow created by a traction pump;

wherein when the auxiliary trenching lever is in the first position, the hydraulic fluid flow created by the trenching pump is combined with the hydraulic fluid flow created by the traction pump.

6. The trenching device of claim 5 wherein the hydraulic fluid flow created by the trenching pump is 13 GPM.

7. The trenching device of claim 5 wherein the hydraulic fluid flow created by the transport pump is 3 GPM.

8. The trenching device of claim 5, wherein the combined fluid flow created by the trenching pump and the traction pump is 16 GPM.

9. A trenching device comprising:

an auxiliary trenching lever that switches the trenching device between at least a trenching mode and a transport mode;

a traction lever that moves in a forward direction and a rearward direction and controls the direction and speed of the trenching device, the speed being controlled by an amount the traction lever is moved;

wherein when the trenching device is in the transport mode, rearward movement of the traction lever is mechanically limited to define a first maximum reverse speed limit that is slower than a maximum forward speed limit; and, wherein when the trenching device is in the trenching mode, reward movement of the traction lever is not mechanically limited to the first maximum reverse speed limit, allowing for reward movement faster than the first maximum reverse speed limit.

10. The trenching device of claim 9 further comprising a reverse tram interlock shaft operably connected to the auxiliary trenching lever and constructed and arranged to mechanically limit the rearward movement of the traction lever when the trenching device is in the transport mode.

11. The trenching device of claim 9, wherein the maximum reverse speed does not exceed a specified 1.55 MPH.

12. A method of regulating speed of a trenching device, comprising:

diverting hydraulic fluid flow from a trenching component of the trenching device to a transport mechanism when the trenching device is in a transport mode such that the transport mechanism receives more hydraulic fluid when the trenching device is in the transport mode than when the trenching device is in a trenching mode;

engaging a limit on an amount of rearward movement of a traction lever that controls reverse movement of the trenching device; and, disengaging the limit on an amount of rearward movement of the traction lever when the trenching component is activated.

13. The method of claim 12 wherein limiting the amount of rearward movement of the traction lever only occurs when the trenching device is the transport mode.

14. The method of claim 12 wherein limiting the amount of rearward movement of the traction lever comprises creating a mechanical interference between the traction lever and another component of the trenching device.

15. The method of claim 12 wherein creating the mechanical interference between the traction lever and the another component of the trenching device comprises placing at least one cam in a path of the rearward movement of the traction lever.

16. The method of claim 15 wherein placing the at least one cam in the path of the rearward movement of the traction lever comprises attaching at least one tab to the traction lever such that the at least one tab will encounter the at least one cam when the traction lever is moved rearwardly and the trenching device is in transport mode.

17. The method of claim 15 wherein placing the at least one cam in the path of the rearward movement of the traction lever comprises moving the at least one cam laterally when the trenching mechanism is placed in the transport mode.

18. The method of claim 17 wherein moving the at least one cam laterally when the trenching mechanism is placed in the transport mode comprises changing a position of an auxiliary trenching lever of the trenching device.

19. The method of claim 12 wherein limiting the amount of rearward movement of the traction lever comprises limiting the amount of rearward movement of the traction lever that correlates to a speed of no more than 1.55 mph.

20. The method of claim 12 wherein diverting hydraulic fluid flow from a trenching component of the trenching device to a transport mechanism when the trenching device is in a transport mode allows the trenching device to travel in a forward direction at a speed that exceeds 1.55 mph.

* * * * *